US006012673A

United States Patent [19]

Kayser et al.

[11] Patent Number: 6,012,673

[45] Date of Patent: Jan. 11, 2000

[54] WINDING DEVICE AND METHOD

[75] Inventors: Franz Kayser, Geldern; Dirk Cramer, Duisburg, both of Germany

[73] Assignee: Voith Sulzer Finishing GmbH, Krefeld, Germany

[21] Appl. No.: 09/129,955

[22] Filed: Aug. 6, 1998

[30] Foreign Application Priority Data

Aug. 12, 1997 [DE] Germany ..... 197 34 829

[51] Int. Cl.[7] ..... B65H 18/14

[52] U.S. Cl. ..... 242/541.5; 242/541.1; 242/547; 242/542.3

[58] Field of Search ..... 242/541.5, 541.6, 242/541.1, 547, 542.3

[56] References Cited

U.S. PATENT DOCUMENTS

| | | | |
|---|---|---|---|
| 3,433,429 | 3/1969 | Schnitzspahn | 242/530.4 |
| 3,792,824 | 2/1974 | Meyer et al. . | |
| 4,105,170 | 8/1978 | Schonmeier | 242/65 |
| 4,746,076 | 5/1988 | Tomma et al. | 242/66 |
| 4,830,303 | 5/1989 | Hagens et al. | 242/67.1 R |
| 4,867,387 | 9/1989 | Schonmeier | 242/65 |
| 4,883,233 | 11/1989 | Saukkonen et al. | 242/66 |
| 5,393,008 | 2/1995 | Kyytsonen et al. | 242/541.1 |
| 5,405,099 | 4/1995 | Hehner et al. | 242/530 |
| 5,577,685 | 11/1996 | Junk | 242/547 |
| 5,632,456 | 5/1997 | Kruger | 242/541.5 |
| 5,639,045 | 6/1997 | Dorfel | 242/527 |
| 5,732,902 | 3/1998 | Tomma et al. | 242/541.5 |

FOREIGN PATENT DOCUMENTS

| | | | |
|---|---|---|---|
| 0829438 | 3/1998 | European Pat. Off. . | |
| 2114479 | 6/1972 | France . | |
| 2633408 | 10/1977 | Germany . | |
| 4012979 | 3/1993 | Germany . | |
| 406191699 | 7/1994 | Japan | 242/541.5 |
| 317269 | 8/1929 | United Kingdom | 242/541.5 |

*Primary Examiner*—Donald P. Walsh
*Assistant Examiner*—Minh-Chau Pham
*Attorney, Agent, or Firm*—Greenblum & Bernstein, P.L.C.

[57] ABSTRACT

Winding device and method for producing a web roll from a material web. The winding device includes a core being adapted to form a web roll, a core holder device, a core drive, a central roll, and a press roll arrangement. The press roll arrangement includes a web tension compensation roll and a mating roll positioned to contact the core at least at a start of winding. The method includes positioning a core in the core holding device, forming a nip between the core and the central roll, positioning a press roll arrangement against the core opposite the central roll, guiding the material web through the nip, and winding the material web onto the core to form a web roll.

19 Claims, 2 Drawing Sheets

WINDING DEVICE AND METHOD

CROSS-REFERENCE TO RELATED APPLICATIONS

The present application claims priority under 35 U.S.C. § 119 of German Patent Application No. 197 34 829.7, filed on Aug. 12, 1997, the disclosure of which is expressly incorporated by reference herein in its entireties.

BACKGROUND OF THE INVENTION

1. Field of the Invention

The present invention relates to a winding device for producing a roll from a material web. The winding device includes a core with a core holder device, a core drive, and a central roll.

2. Discussion of the Background Information

A winding device, as disclosed in DE 40 12 979, can be formed as a center winder. Winding devices of this type are generally utilized to wind material webs, e.g., paper webs, into rolls to facilitate further processing or delivery. Cores for these rolls are generally cardboard winding tubes that only have limited stability.

In center winders, the winding tubes (or cores) of the material web rolls are held on their ends by clamping spindles. In this manner, the winding tubes can be driven at one end. Further, these winding tubes are pressed against a central roll via brackets to apply a tensile stress that produces a suitable winding hardness.

Due to insufficient stiffness of the winding tubes, the tubes are bent at the start of the winding process, e.g., by a contact force and tension of the material web, which causes poor winding results.

SUMMARY OF THE INVENTION

The present invention provides a winding device that does not suffer from the above-noted drawbacks of the prior art.

The present invention provides a winding device of the type generally discussed above that includes a press roll arrangement positioned to contact the roll, at least at the start of the winding procedure. The press roll arrangement includes a web tension compensation roll and a mating roll.

Via the press roll arrangement, forces acting on the core can be, to a large extent, compensated for, and, in many cases, almost completely compensated. The forces compensated include forces pressing the core against the mating roll and forces exerted by the web tension. Moreover, sagging of the core can also be prevented or substantially reduced by the press roll arrangement. In this regard, because the present invention initially provides a "straighter" core than the prior art arrangements, the material web can be wound more efficiently from the start of the winding procedure to produce a roll wound more uniformly from the beginning. As a result of utilizing the press roll arrangement having at least two rolls, greater winding control is obtained. That is, the core is initially located within a triangle formed between three rolls, i.e., a central roll, the mating roll, and the web tension compensation roll. By adjusting the forces with which these rolls work against each other, a good balance between these rolls may be achieved. In this way, the present invention substantially prevents deformation of the core along its axis.

In a particular embodiment of the present invention, the material web may be guided through a nip or opening between the central roll and the material web roll. A first plane may be considered as extending through the axis of the material web roll and a second plane may be considered as extending through the axes of the central roll and the material web roll. The press roll arrangement may be located on a side of a first plane opposite the central roll. While it would appear appropriate to position the web tension compensation roll where the web tension occurs, i.e., on the same side of the first plane as the material web runs, because of the additional mating roll, the web tension compensation roll can be placed on the opposite side of the first plane. In this manner, the contact pressure of the material web roll against the central roll may be advantageously achieved via the web tension compensation roll. This is particularly important at the beginning of a winding procedure because, as higher contact pressure is applied, the greater the winding hardness that can be achieved. Particularly, greater winding hardness is particularly desirable at the interior of the roll, and the hardness should decrease as the roll diameter increases. If the web tension compensation roll were placed on the side of the first plane with the material web run, there would be a risk that the material web roll would be lifted away from the central roll. To overcome this disadvantage, it would be necessary to press the mating roll in the direction of the central roll with still greater force. As a result, the core and the material web could be damaged.

In a further embodiment of the present invention, the second plane may be oriented to be substantially horizontal. In this manner, the weight of the roll has substantially no effect on the winding hardness. Instead, the hardness is influenced only by external forces.

In an exemplary embodiment of the present invention, the axes of the web tension compensation roll and the mating roll may be located on different sides of the second plane. In this manner, the roll is adequately supported against the web tension and the roll remains in position during winding.

Advantageously, the web tension compensation roll and the mating roll are mounted on a common carrier. Thus, they can always be operated together, and, for example, may be positioned against the core at the start of winding procedure.

Advantageously, the web tension compensation roll and the mating roll are fixedly mounted on the carrier. Thus, the two rolls can move together so that motion control of only one roll or of the carrier is necessary to ensure the required support of the core or the roll during the relevant portions of the winding process.

Further, the press roll arrangement is movable along a path of motion that is oriented at an angle of, e.g., approximately 5° to 10° relative to the second plane. This makes allowance for the changing diameter of the roll. The forces acting on the roll can then be selectively changed during winding.

The path of motion may be located on the same side of the second plane as the incoming material web. Thus, as the diameter increases, continuous support of the roll against the tensile force of the web tension and the increasing force of the weight occurs.

The press roll arrangement can be lifted away from the roll. It is not necessary for the press roll arrangement to be in contact with the roll during the entire winding procedure. For example, after a predetermined number of material web layers are wound on the core, the stability of the roll may be sufficiently increased that support by the press roll arrangement is no longer necessary. Thus, by lifting the pressing roll arrangement away from the roll, wear of the press roll arrangement and stress on the material web can be substantially reduced.

The web tension compensation roll may contact the roll with greater force than the mating roll. Thus, the force to support against web tension is greater than the force with which the roll is pressed against the central roll.

The present invention is directed to a winding device for producing a roll from a material web. The winding device includes a core being adapted to form a web roll, a core holder device, a core drive, a central roll, and a press roll arrangement. The press roll arrangement includes a web tension compensation roll and a mating roll positioned to contact the core at least at a start of winding.

In accordance with another feature of the present invention, a nip is formed between the central roll and the web roll and the material web is adapted to be guided through the nip. A first plane arranged to extend through an axis of the web roll, and a second plane arranged substantially perpendicular to the first plane and extending through axes of the web roll and central roll. The press roll arrangement is positioned on a side of the first plane opposite the nip. Further, the second plane is substantially horizontally oriented. Further still, axes of the web tension compensation roll and the mating roll are positioned on opposite sides of the second plane.

In accordance with another feature of the present invention, a common carrier is provided, and the web tension compensation roll and the mating roll are mounted on the common carrier. Further, the web tension compensation roll and the mating roll are positionally fixed on the common carrier.

In accordance with still another feature of the present invention, the press roll arrangement is movable along a path of motion oriented at an angle of between approximately 5° and 10° to the second plane. Further, the path of motion is located on a same side of the second plane as an incoming direction of the material web through the nip.

In accordance with a further feature of the present invention, the press roll arrangement is adapted to be lifted away from the web roll.

In accordance with a still further feature of the present invention, the web tension compensation roll contacts the web roll with greater force than the mating roll contacts the web roll.

The present invention is directed to a method of winding a material web onto a core in a winding machine that includes a central roll, a core holding device, and a core driving device. The method includes positioning a core in the core holding device, forming a nip between the core and the central roll, positioning a press roll arrangement against the core opposite the central roll, guiding the material web through the nip, and winding the material web onto the core to form a web roll.

In accordance with another feature of the present invention, the press roll arrangement includes a web tension compensation roll and a mating roll. The method further includes positioning the web tension compensation roll and the mating roll on opposite sides a plane formed through an axis of the core and an axis of the central roll. Further, the method includes positioning the web tension compensation roll and the mating roll on opposite sides of a second plane formed substantially perpendicularly to the plane through the axes of the core and the central roll.

In accordance with still another feature of the present invention, the method further includes, as the web roll diameter increases, moving the press roll arrangement outwardly at an angle of between approximately 5° and 10° to a plane formed between an axis of the core and an axis of the central roll. Further, the direction of outwardly movement is on a same side of the plane as a direction from which the material web is supplied. Further still, the direction of outwardly movement is opposite a direction from which the material web is supplied.

In accordance with a further feature of the present invention, the web tension compensation roll contacts the web roll with greater force than the mating roll contacts the web roll.

The present invention is directed to a press roll arrangement for a winding device that includes a web tension compensation roll, a mating roll, and a carrier. The web tension compensation roll and the mating roll are rotatably coupled to the carrier in a positionally fixed arrangement.

In accordance with a further feature of the present invention, the web tension compensation roll and the mating roll are adapted to form an angle of greater than approximately 90° with a roll core at a beginning of a winding process.

In accordance with yet another feature of the present invention, the web tension compensation roll is adapted to exert greater force on the core than the mating roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
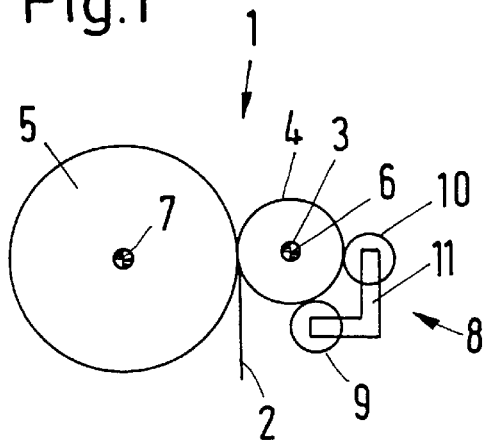
FIG. 1 illustrates a schematic representation of a winding device.

A winding device 1 illustrated in FIG. 1 is utilized to wind a material web 2, e.g., a paper web, onto a core 3 to form a roll 4. During winding, roll 4 contacts a central roll 5. Core 3 and central roll 5 both have drives 6 and 7, respectively. Drive 6 of core 3, while not depicted in detail, may be, e.g., a known arrangement in which one of the two clamping spindles holding core 3 in the region of its axial ends is driven.

The axial length of core 3 increases as the width of roll 4 increases, i.e., the axial length of core 3 corresponds with the width of roll 4. In many cases, core 3 may be a cardboard winding tube that is deformed under the effects of, e.g., web tension.

In other words, the tensile force exerted by material web 2 during at least the beginning of the winding procedure bends core 3.

To counter this deformation of core 3, a press roll arrangement 8, which includes a web tension compensation roll 9 and a mating roll 10, may be provided. Web tension compensation roll 9 and the mating roll 10 may be mounted on a common carrier 11 so as to maintain a fixed relation to each other on carrier 11.

As the diameter of the roll 4 increases, the press roll arrangement 8 moves outwardly. This movement is explained with reference to FIG. 2. Core 3, i.e., at the start of the winding process, is depicted in solid lines along with web tension compensation roll 9 and mating roll 10, also in solid lines. At a later stage in the winding process, roll 4, having a larger diameter, is shown in dashed lines. For the sake of clarity, core 3 is not depicted in the later stage of winding, and web tension compensation roll 9 and mating roll 10 are shown in dashed lines. As illustrated, the fixed position between web tension compensation roll 9 and mating roll 10 has not changed during the winding process. Thus, an angle formed between these rolls and core 3 decreases as the roll diameter increases.

At a start of the winding process, i.e., when material web 2 is being fed or guided, e.g., from below, into a nip formed between core 3 and central roll 5, web tension compensation roll 9 is positioned almost beneath core 3. However, the axis 12 of web tension compensation roll 9 is arranged on a side of an imaginary first plane 16 opposite the material web 2. First plane 16 extends through rotational axis 14 of core 3 and is substantially perpendicular to a second plane 17 that extends through axes 14 and 15 of core 3 and central roll 5, respectively.

Mating roll 10 has an axis 13 that is positioned on the same side of first plane 16 as axis 14, but is positioned on the opposite side of second plane 17 from axis 14.

Figure 2:
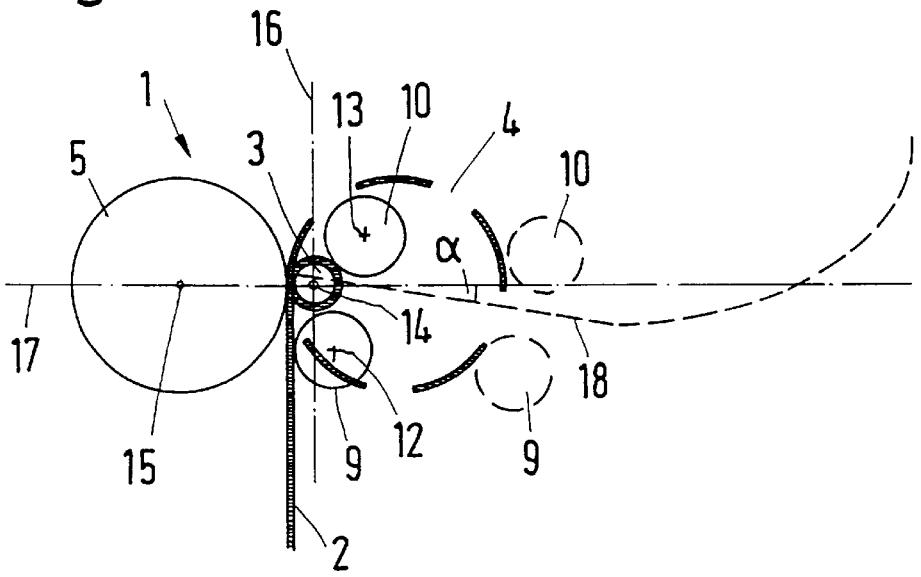
FIG. 2 illustrates a schematic representation of the path of motion of a pressing roll arrangement.

FIG. 2 also illustrates, in dashed lines, a path of motion 18 of press roll arrangement 8 as the winding process advances. As illustrated, the path of motion 18 may be oriented at an angle $\alpha$ of, e.g., between approximately 5° and 10°. As illustrated, angle $\alpha$ may be oriented, e.g., approximately 8° to second plane 17. Second plane 17 may be substantially horizontal so that core 3 or roll 4 and central roll 5 are not influenced by their respective weights.

As a result of the tilted path of motion 18, web tension compensation roll 9 can provide support even as the diameter of roll 4 increases, even after it is no longer necessary for mating roll 10 to counter or oppose forces due to web of the tension compensation roll 9. Further, mating roll 10 may be utilized to press roll 4 against central roll 5, thus, to influence winding hardness.

It can be seen that, at a certain distance from the starting point, i.e., where core 3 is in contact with central roll 5, path of motion 18 may take a course in which the press roll arrangement 8 is lifted away from roll 4. In general, it suffices if press roll arrangement 8 remains in contact with roll 4 and transmits a force to the same over a range of diameters up to approximately 500 mm. This is true particularly when rolls 9 and 10 are provided with elastic coatings.

In a starting position, i.e., when rolls 9 and 10 act directly on core 3, an angle between the axes of rolls 9 and 10 and axis 14 of core 3 should be greater than approximately 90°.

Figure 3:
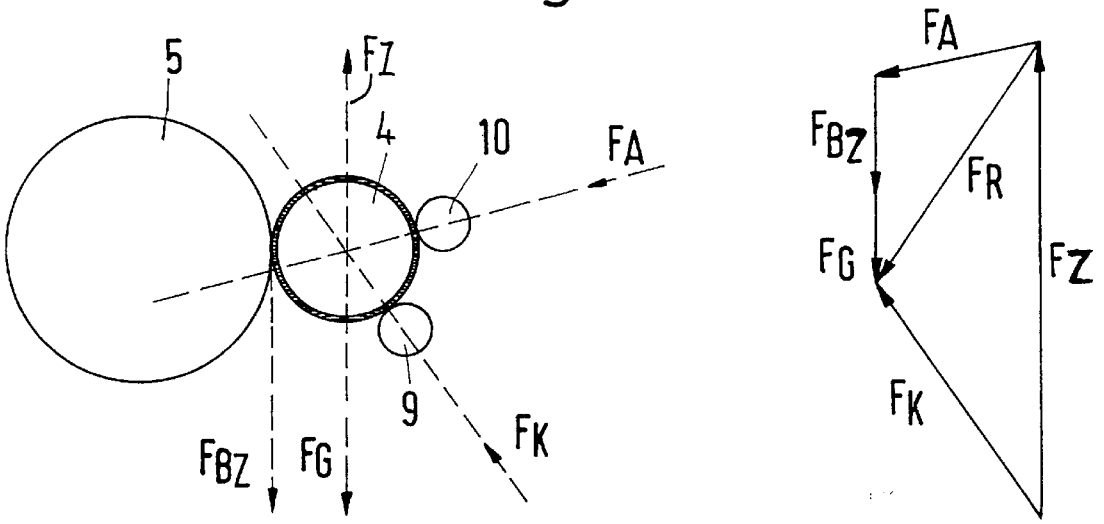
FIG. 3 illustrates a schematic representation of the exerted forces.

The forces acting on roll 4 are schematically illustrated in FIG. 3. These forces include tensile stress $F_{BZ}$, weight $F_G$, the force on the clamping spindles $F_Z$, the contact force $F_A$, and the compensation force $F_K$. In FIG. 3, an associated force diagram is depicted adjacent to the schematic representation of rolls 5, 9, 10 and 4. Contact force $F_A$, weight $F_G$, and tensile stress $F_{BZ}$ may be added to produce a resultant force $F_R$, which maintains equilibrium with compensation force $F_K$ and clamping spindles force $F_Z$.

The magnitudes of these forces will generally vary with the specifics of a particular web material, e.g., basis weight and specific weight, and in accordance with amount of winding that has been performed. For example, depending upon the web material and the magnitude of the roll, $F_G$ may be between, e.g., 4 and 360 kg/m and $F_{BZ}$ may be between, e.g., 350 and 1200 N/m. Thus, from the disclosed features of the present invention, it is within the purview of the ordinarily skilled artisan to provide specifically configure the press roll arrangement 8 for a specific web material so that vertical components of forces $F_A$ and $F_K$ compensate $F_G$ and $F_{BZ}$.

Figure 4:
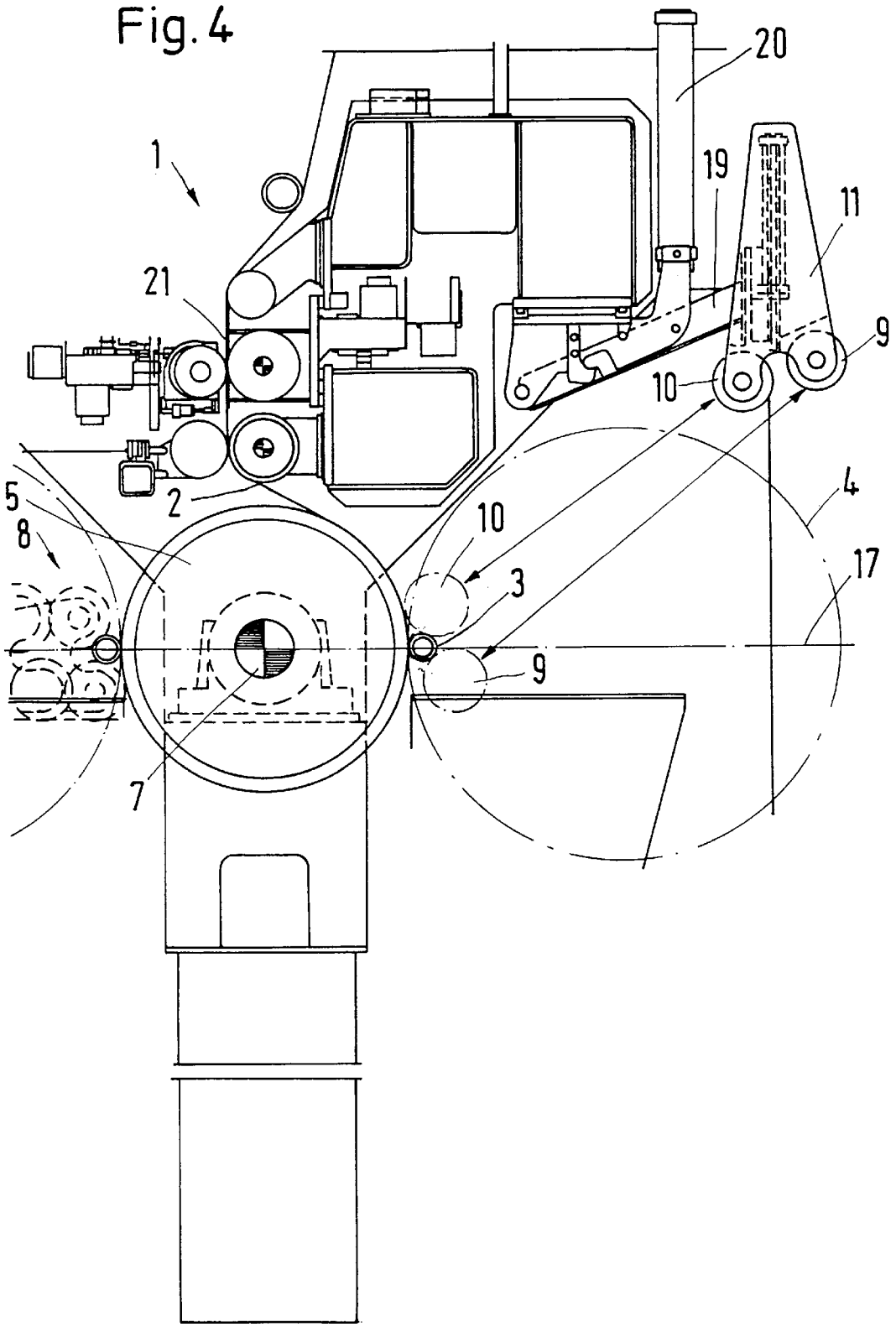
FIG. 4 illustrates an exemplary embodiment of the present invention.

FIG. 4 illustrates an exemplary winding device for implementing the features of the present invention. Carrier 11 may be mounted on a swing arm 19 that can be swung, via a piston/cylinder arrangement 20, from the illustrated resting position to a working position in which rolls 9 and 10 contact core 3.

Further, as depicted in dashed lines, another roll may be formed on an opposite side of central roll 5. In this arrangement, because material web 2 is fed into the nip between the winding core and central roll 5 from below, i.e., after passing around central roll 5, the path of motion of press roll arrangement 8 may be tilted or oriented downward while it is tilted or oriented upward on the right side in FIG. 4.

A winding device of this type is particularly useful when utilized in conjunction with a roll cutter 21.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An apparatus for producing a roll from a material web comprising:

a core being adapted to form a web roll;

a core holder device;

a core drive;

a central roll;

a press roll arrangement, comprising a web tension compensation roll and a mating roll, positioned to contact the core at least at a start of winding; and the web tension compensation roll contacts the web roll with greater force than the mating roll contacts the web roll.

2. The device in accordance with claim 1, further comprising:

a nip formed between the central roll and the web roll, the material web being adapted to be guided through the nip, wherein a first plane extends through an axis of the core and a second plane, which is substantially perpendicular to the first plane, extends through axes of the core and central roll; and the press roll arrangement being positioned on a side of the first plane opposite the nip.

3. The device in accordance with claim 2, wherein the second plane is substantially horizontally oriented.

4. The device in accordance with claim 2, axes of the web tension compensation roll and the mating roll being positioned on opposite sides of the second plane.

5. The device in accordance with claim 1, further comprising:

a common carrier; and the web tension compensation roll and the mating roll being mounted on the common carrier.

6. The device in accordance with claim 5, the web tension compensation roll and the mating roll being positionally fixed on the common carrier.

7. The device in accordance with claim 1, the press roll arrangement being adapted to be lifted away from the web roll.

8. An apparatus for producing a roll from a material web comprising:

a core being adapted to form a web roll;

a core holder device;

a core drive;

a central roll;

a press arrangement, comprising a web tension compensation roll and a mating roll, positioned to contact the core at least at a start of winding; and the press roll arrangement being movable along a path of motion oriented at an angle of between approximately 5° to 10° to a plane which extends through axes of the core and the central roll.

9. The device in accordance with claim 8, the path of motion being located on a same side of the second plane as an incoming direction of the material web through the nip.

10. A method of winding a material web onto a core in a winding machine that includes a central roll, a core roll holding device, and a core driving device comprising:

positioning a core in the core holding device;

forming a nip between the core and the central roll;

positioning a press roll arrangement against the core opposite the central roll;

guiding the material web through the nip; and winding the material web onto the core to form a web roll, wherein the press arrangement comprises a web tension compensation roll and a mating roll, and the web tension compensation roll contacts the web roll with greater force than the mating roll contacts the web roll.

11. The method in accordance with claim 10, wherein the press roll arrangement comprising a web tension compensation roll and a mating roll, and the method further comprising:

positioning the web tension compensation roll and the mating roll on opposite sides a plane formed through an axis of the core and an axis of the central roll.

12. The method in accordance with claim 11, the method further comprising:

positioning the web tension compensation roll and the mating roll on opposite sides of a second plane formed substantially perpendicularly to the plane through the axes of the core and the central roll.

13. The method in accordance with claim 10, the method further comprising:

as the web roll diameter increases, moving the press roll arrangement outwardly at an angle of between approximately 5° and 10° to a plane formed between an axis of the core and an axis of the central roll.

14. The method in accordance with claim 13, wherein the direction of outwardly movement is on a same side of the plane as a direction from which the material web is supplied.

15. The method in accordance with claim 13, wherein the direction of outwardly movement is opposite a direction from which the material web is supplied.

16. A press roll arrangement for a winding device comprising:

a web tension compensation roll;

a mating roll;

a carrier roll; and the web tension compensation roll and the mating roll being rotatably coupled to the carrier and positionally fixed with respect to each other.

17. The press roll arrangement in accordance with claim 18, wherein the web tension compensation roll and the mating roll are adapted to form an angle of greater than 90° with a roll core at a beginning of a winding process.

18. The press roll arrangement in accordance with claim 16, wherein the web tension compensation roll is adapted to exert greater force than the mating roll.

19. The press roll arrangement in accordance with claim 16, wherein the web tension compensation roll is positioned and adapted to exert a force to offset a web tension force.

* * * * *